US005895101A

United States Patent [19]

Cabrales et al.

[11] Patent Number: 5,895,101

[45] Date of Patent: Apr. 20, 1999

[54] DRAWER SLIDE

[75] Inventors: Rahl F. Cabrales, Fullerton; Robert J. Cammack, Fountain Valley, both of Calif.

[73] Assignee: Accuride International Inc., Santa Fe Springs, Calif.

[21] Appl. No.: 08/820,305

[22] Filed: Mar. 18, 1997

[51] Int. Cl.[6] ..... A47B 88/00

[52] U.S. Cl. ..... 312/334.11; 312/334.12; 312/334.17

[58] Field of Search ..... 312/334.7, 334.9, 312/334.11, 334.12, 334.15, 334.17, 334.18, 334.25, 334.26, 334.33, 334.37, 334.38, 334.39; 384/18, 19

[56] References Cited

U.S. PATENT DOCUMENTS

| | | | |
|---|---|---|---|
| 2,370,861 | 3/1945 | Jakeway . | |
| 2,649,346 | 8/1953 | Woina et al. . | |
| 2,671,699 | 3/1954 | Vignos | 384/18 |
| 3,451,730 | 6/1969 | Krispinsky et al. . | |
| 3,588,198 | 6/1971 | Stewart et al. . | |
| 3,912,341 | 10/1975 | Stein . | |
| 4,181,383 | 1/1980 | Naef | 384/19 |
| 4,200,342 | 4/1980 | Fall . | |
| 4,564,247 | 1/1986 | Knoop | 384/19 |
| 4,662,761 | 5/1987 | Hoffman . | |
| 4,752,142 | 6/1988 | Jackson et al. | 384/18 |
| 4,944,605 | 7/1990 | Shen | 312/334.11 X |
| 5,472,272 | 12/1995 | Hoffman . | |

FOREIGN PATENT DOCUMENTS

| | | | |
|---|---|---|---|
| 0583978A1 | 2/1994 | European Pat. Off. . | |
| 2448335 | 4/1976 | Germany | 312/334.12 |
| 2607171 | 9/1977 | Germany | 312/334.12 |
| 620460 | 3/1949 | United Kingdom . | |
| 783826 | 10/1957 | United Kingdom . | |
| 2061705 | 5/1981 | United Kingdom . | |

*Primary Examiner*—Peter M. Cuomo
*Assistant Examiner*—Janet M. Wilkens
*Attorney, Agent, or Firm*—Christie, Parker & Hale, LLP

[57] ABSTRACT

An improved drawer slide member ball bearing raceway. The improved raceway comprises a square U-channel shape with double indentations restricting lateral movement of the ball bearings contained therein. Alternatively, a shoulder may be formed in the raceway restricting lateral movement of the ball bearings in the direction towards a web of the slide member, thereby providing both ball bearing float and reducing the amount of lean of an inner or intermediate slide member.

10 Claims, 4 Drawing Sheets

DRAWER SLIDE

FIELD OF THE INVENTION

The present invention relates to slide members for ball bearing slides. The invention specifically relates to an improvement in the ball bearing raceway of a slide member.

BACKGROUND OF THE INVENTION

Telescopic slides for file drawers and the like are often desirable for use in cabinets and other rack-mounted applications. Such slides permit easy access to the interior of the drawer. The slides maintain the drawer in a horizontal position regardless of how far the drawer is withdrawn from the cabinet. A typical drawer slide has two or three slide members slidably secured to each other by sets of ball bearings held by retainers riding in raceways formed on the slide members.

Two-element telescopic slides normally include an outer slide member and an inner slide member. For purposes of exposition, the outer slide member is connected to the cabinet or enclosure, although it is recognized that the inner slide member may instead be so connected. When the outer slide member is connected to the cabinet or enclosure, the slide member affixed to the drawer is the inner slide member. The slide members are often slidably connected through the use of ball bearings which are in rolling engagement with raceways formed on the slides. A three-element telescopic slide will additionally normally include an intermediate slide member slidably connected to and between the outer and inner slide members.

A typical drawer will often have two slides securing the drawer to the cabinet or enclosure, with slides attached to each of the outside of the vertical side walls of the drawer (shown in FIG. 7). When a drawer attached to a cabinet or enclosure through the use of telescopic slides is opened, the slide members of each slide extend longitudinally with respect to the other slide members of that slide. Some lateral movement of the slide members relative to one another may also be desirable, however. This is because inaccuracies may be present in the width of the cabinet opening or the width of the drawer such that the slides do not fit snugly between the cabinet and the drawer. The result of inaccuracies in cabinet and drawer construction may require that spacing strips be mounted between the drawer and the telescopic slide or between the cabinet and the telescopic slide, or both, to provide for an exact fit. Additionally, these inaccuracies in dimensions may cause the ball bearing raceways to exert excessive lateral forces on the ball bearings or the retainers for ball bearings and thereby make slide movement more difficult.

One solution known in the art which allows some lateral movement between adjacent slide members is to provide substantially flat bearing raceways which allow the bearings some lateral movement, or float, in the bearing raceways of one of the slide members. The Model 3800 slide from Accuride International Inc., for example, incorporates such substantially flat bearing raceways. A slide embodying such a configuration may be seen in FIG. 1, wherein an outer slide member 11 has avertical web 12 and substantially flat horizontal arms 13, 15 extending from the top and bottom of the vertical web 12. Lips 17, 19 extend vertically inward from the horizontal arms 13, 15. The arms 13, 15 in conjunction with the web 12 and the lips 17, 19 form upper and lower substantially square U-channel bearing raceways in which ball bearings 21, 23 ride. For purposes of exposition these ball bearings shall be referred to as outer upper ball bearings 23 and outer lower ball bearings 21. The outer ball bearings 21, 23 comprise multiple ball bearings held by ball bearing retainers 25, 27. The outer ball bearings 21, 23 are able to locate themselves laterally along the flat arms 13, 15 to the extent allowed by the ball bearing retainers 25, 27, which may contact either the web 12 or the lips 17, 19 which form the sides of the U-channel bearing raceways.

The outer ball bearings 21, 23 slidably connect the outer slide member 11 to an intermediate slide member 29. The intermediate slide member 29 has a vertical web 31 from which extends substantially horizontal arms 32, 34. The substantially horizontal arms 32, 34 are not substantially flat, instead having vertically inward curves proximate the vertical web forming vertically outward concave outer ball bearing raceways 33, 35. The vertically inward curves are followed by vertically outward curves forming vertically inward concave inner ball bearing raceways 37, 39. The concave shape of the inner and outer ball bearing raceways restrict ball bearings placed therein from moving laterally. The outer ball bearings 21, 23 are in rolling engagement with the outer raceways 33, 35. Inner ball bearings 41, 43 are located in the inner raceways 37, 39, and are held by a common bearing retainer 45 which has a shape similar to the intermediate slide member 29. The ball bearings 41, 43 are in rolling engagement with ball bearing raceways 51, 53 of an inner slide member 47. The inner slide member 47 comprises a substantially flat vertical web 49 with protruding horizontal arms 50, 52 having inward curves forming vertically outward concave bearing raceways 51, 53. As with the intermediate slide member 29, the concave shape ball bearing raceways 51, 53 of the inner slide member 47 do not allow for lateral ball bearing movement. The inner slide member 47 is attached to a vertical side wall 55 of a drawer through the use of screws 57 or through other methods and devices known in the art.

When the drawer is fully loaded, the weight of the drawer is transferred by the screws 57 to the inner slide member 47. This weight, or load, is transmitted from the inner slide member 47 to the intermediate slide member 29 by the lower inner bearings 41. The lower outer bearings 21 transmit the load from the intermediate slide member 29 to the outer slide member 11. The outer slide member transmits the load to the cabinet or enclosure. So long as no deformation of the drawer, the slide members, or the cabinet or enclosure occurs, the result will be that the weight of the drawer is transmitted in a problem free manner to the cabinet or enclosure.

Bearing float, however, which provides for greater ease of drawer and cabinet connection, allows for lateral movement of the upper and lower outer ball bearings 23, 21 in opposing directions. In particular, the upper ball bearings 23 may move laterally away from the web of the outer slide member while the lower ball bearings move laterally towards the web of the outer slide member. This opposing lateral motion may occur because the inner ball bearings 41, 43 are offset horizontally from the outer lateral ball bearings 21, 23. The lower horizontal protruding arm 32 of the intermediate slide member 29 therefore acts as a lever arm and causes the lower ball bearings 21 to move laterally towards the web 12 of the outer slide member 11 thereby pivoting the intermediate slide member. As the intermediate slide member 29 pivots, the upper ball bearings 23 move laterally towards the outer lip 19 of the upper U-channel bearing raceway. If the vertical side wall 55 of the drawer is sufficiently inflexible, however, the intermediate slide member 29 will not pivot. This is because the inner slide member 47 and intermediate slide member 29 are laterally fixed in position relative to one another because the inner ball bearings are constrained from moving laterally and the sturdy vertical side wall 55 of the drawer prevents pivoting of the inner slide member 47.

Economies in the manufacture of drawers and cabinets, however, increasingly cause the utilization of thinner and weaker materials. One such material is used in the vertical side wall of a drawer shown in FIG. 2. Whereas the inner and intermediate slide members shown in FIG. 1 are maintained in position by the sturdy vertical side wall 55 of the drawer, the same slide members in FIG. 2 are not maintained in position as the thin side wall material 101 of the drawer in FIG. 2 allows the inner slide member 47 to pivot and thereby deform the side wall 101. As previously described, the intermediate slide member 29 pivots when the drawer is loaded. The result of such pivoting is that the lower ball bearing retainer 25 contacts the vertical web 12 of the outer slide member 11 and the upper ball bearing retainer 27 contacts the upper lip 19 of the square U-channel. Additionally, a portion of the intermediate slide member 29 contacts the vertical web 12 of the outer slide member 11. Thus, the slide does not operate as smoothly as possible due to the frictional contact between the ball bearing retainers 25, 27 and the outer slide member 11, and due to the frictional contact between the intermediate slide member 29 and the outer slide member 11. As the coefficient of friction may be greater for the material of the intermediate slide member than that of the bearing retainers, the frictional contact between the slide members is particularly undesirable. Furthermore, the drawer cabinet material 101 has also likely been damaged.

Thus, there is a need for a drawer slide that provides lateral ball bearing float to increase the ease of attaching drawers to cabinets while avoiding the above-described problems. Additionally, there is a need to provide slides with the square U-channel-shaped raceways found popular with customers with a slide of a corresponding shape which does not allow the aforementioned problems.

SUMMARY OF THE INVENTION

The present invention provides a drawer slide member with an improved square U-channel bearing raceway in a telescopic drawer slide. The U-channel bearing raceway comprises a substantially flat horizontal surface bounded by a vertical web and a vertical lip, with a shoulder proximate the vertical web. The shoulder may be formed in a number of ways, including providing bends or indentations in the horizontal surface. The shoulder limits the movement of bearings placed in the raceway in the direction towards the vertical web. The lip limits the movement of the bearings away from the vertical web, generally through contact with a bearing retainer. Thus, if the drawer slide extends longitudinally, the shoulder and the lip limit the lateral movement of the bearings.

Alternately, the horizontal surface has a sinusoidal shape providing convex and concave surfaces. Two convex surfaces are provided astraddle a concave surface near the mid-point of the horizontal surface, with additional concave surfaces adjacent to the vertical web and the vertical lip. The concave surface near the mid-point is adapted to receive ball bearings, and the concave surfaces adjacent the vertical web and the vertical lip provide clearance for a ball bearing retainer.

By providing such improved U-channel raceways, problems associated with movement of upper and lower ball bearings in a drawer slide in opposing lateral directions, such as frictional contact between slide members or deformation of drawer side walls, is minimized or avoided.

Many of the attendant features of this invention will be more readily appreciated as the same becomes better understood by reference to the following detailed description and considered in connection with the accompanying drawings in which like reference symbols designate like parts throughout.

BRIEF DESCRIPTIONS OF THE DRAWINGS

DETAILED DESCRIPTION

Figure 1:
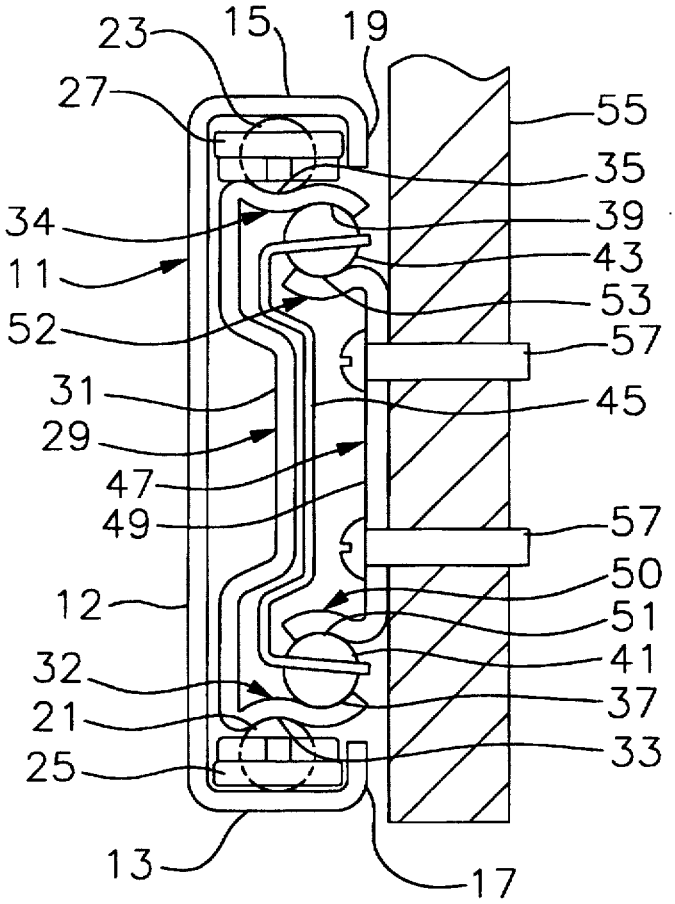
FIG. 1 PRIOR ART
FIG. 1 is a cross-section of a prior art slide mounted to a sturdy cabinet drawer.
Figure 2:
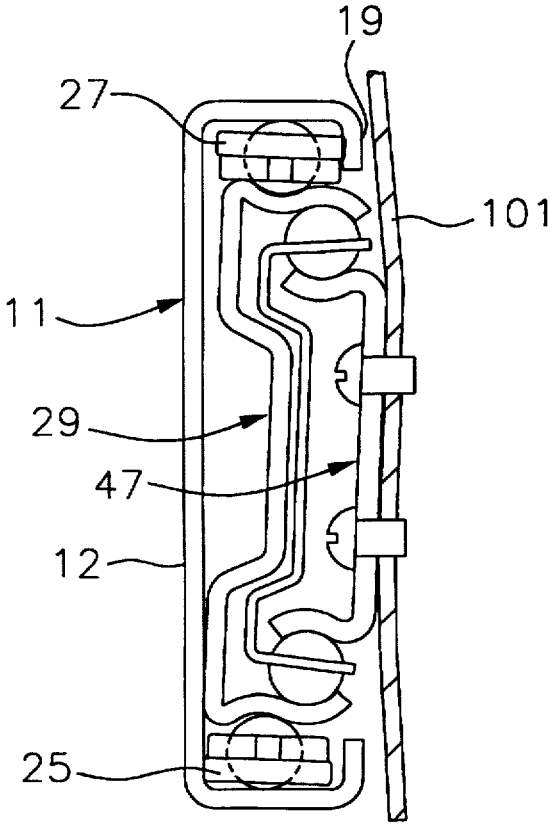
FIG. 2 PRIOR ART
FIG. 2 is a cross-section of the prior art slide of FIG. 1 mounted to a thin vertical side wall at a cabinet drawer.
Figure 3:
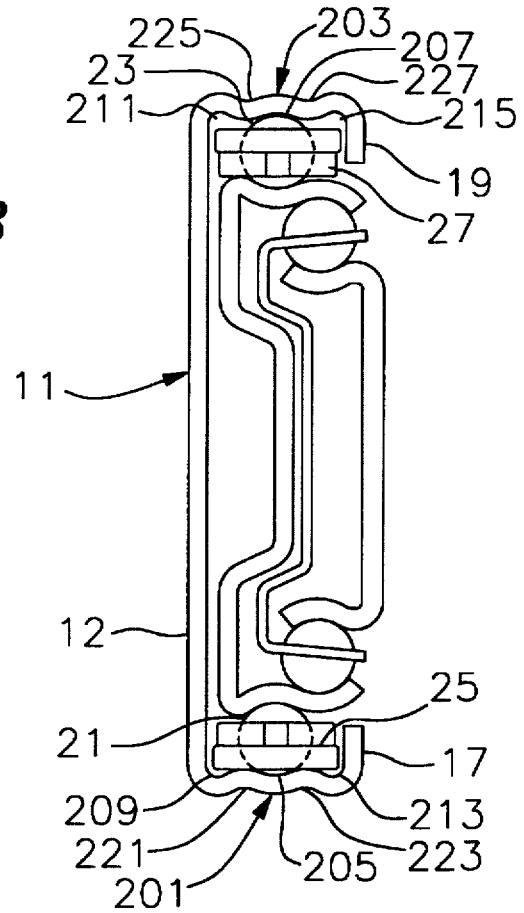
FIG. 3 is a cross-section of an embodiment of the slide of the present invention.

A slide embodying the present invention is shown in FIG. 3. As viewed in FIG. 3, the outer slide member 11 has a vertical web 12, substantially horizontal arms 201, 203 extending from the web, and lips 17, 19 extending inward from the ends of the horizontal arms. The vertical web 12, the horizontal arms 201, 203, and the lips 17, 19 form U-channel bearing raceways. The lips 17, 19 reduce the amount of dust and other foreign material that may enter the bearing raceways, and may strengthen the bearing raceways. The horizontal arms 201, 203 have double indentations 221, 223, 225, 227 placed therein thereby giving the horizontal arms a sinusoidal cross section. As shown, the sinusoidal cross section has a slope with no discontinuities. In other words, the horizontal arms have a first inward curve proximate the vertical web, followed by an outward curve, which, in turn, is followed by an inward curve proximate the vertical lips. The outer ball bearings are placed in the outward curves which, forming vertically inward facing concave surfaces 205,207, restrict lateral movement of the outer bearings 21, 23. The outward curves also provide a generally smooth semi-circular surface. Such a surface largely avoids problems with surface irregularities, such as burrs that may be found on the edges of grooved channels. Thus, by slightly modifying the flat raceways 13, 15 (shown in FIG. 1) of the prior art, the shape of the substantially U-shaped channel is largely maintained and the undesirable opposing lateral motion of the ball bearings 21, 23 is avoided. Problems associated with cut grooves and the like may also be avoided. Additionally, the double indentations provide clearance slots 209, 211, 213, 215 for the bearing retainers 25, 27, so as to avoid frictional contact between the upper and lower surfaces of the outer edges of the bearing retainers and the outer slide member or foreign material that becomes lodged therebetween.

Figure 4:
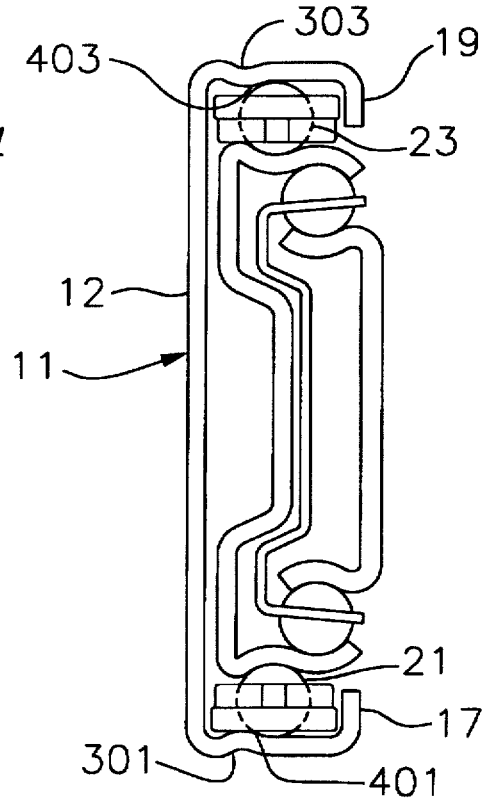
FIG. 4 is a cross-section of an alternate embodiment of the slide of the present invention.

A slide incorporating a slide member with an alternate embodiment of the improved U-channel bearing raceway of the present invention is shown in FIG. 4. In this alternate embodiment, single indentations 301, 303 are placed in the horizontal arms proximate to the vertical web 12 of the outer slide member 11. The single indentations 301, 303 form inward curves, or shoulders 401, 403, which restrict lateral movement of the bearings 21, 23 towards the web 12 of the outer slide member 11. Bearing float, however, is still provided as the bearings may move laterally between the point at which the bearings contact the shoulders 401, 403 and the point at which the bearing retainers contact the lips 17, 19.

Figure 5:
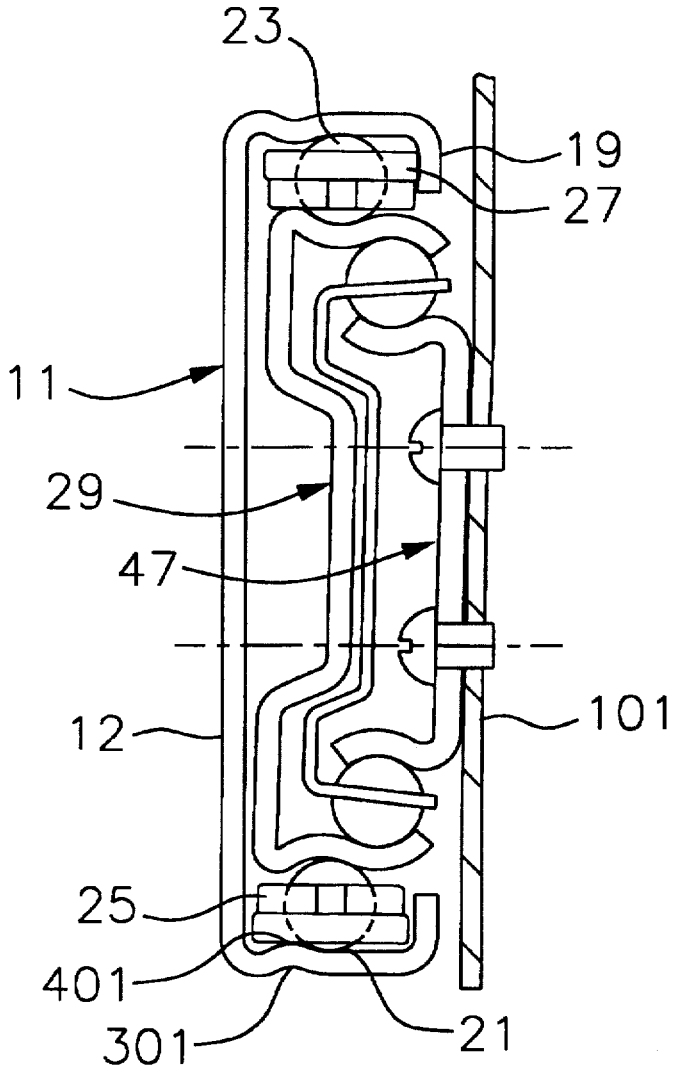
FIG. 5 is a cross-section of the slide of FIG. 4 mounted to a thin vertical side wall of a cabinet drawer.

As can be seen in FIG. 5, when the inner slide member 47 is mounted to the thin vertical side wall 101 of a drawer, the degree of pivot of the intermediate slide member 29 is limited because the lower bearings 21 are constrained from excessive lateral movement in the direction towards the web 12 by the shoulder 401 formed by the indentation 301. Although the weight or load transfer occurs in a manner similar to that previously described, the pivoting of the intermediate slide member is constrained due to the restriction on the lateral movement of the outer lower bearings 21. The intermediate slide member 29 therefore cannot frictionally contact the web 12 of the outer slide member 11. The restriction on lateral movement also prevents contact between the lower bearing retainer 25 and the web 12. Although the upper bearing retainer 27 is in contact with the upper lip 19, such contact does not provide difficulties of the same magnitude as those posed by contact between the lower bearing retainer 25 and the web 12 because the upper bearings 23 are not bearing as great a load as that borne by the lower bearing 21, and therefore the induced frictional forces may not be as great. Furthermore, the reduced magnitude of the pivot of the intermediate slide member 29, approximately 1.3 degrees in the embodiment shown, is believed insufficient to noticeably or permanently deform the thin drawer material 101 when the thin drawer material is 24-gauge steel, for example.

Figure 6:
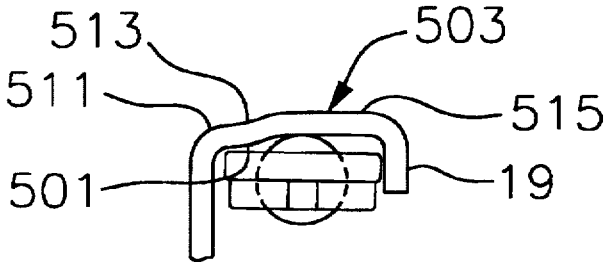
FIG. 6 is a cross-section of another alternate embodiment of the bearing raceway of the present invention.
Figure 7:
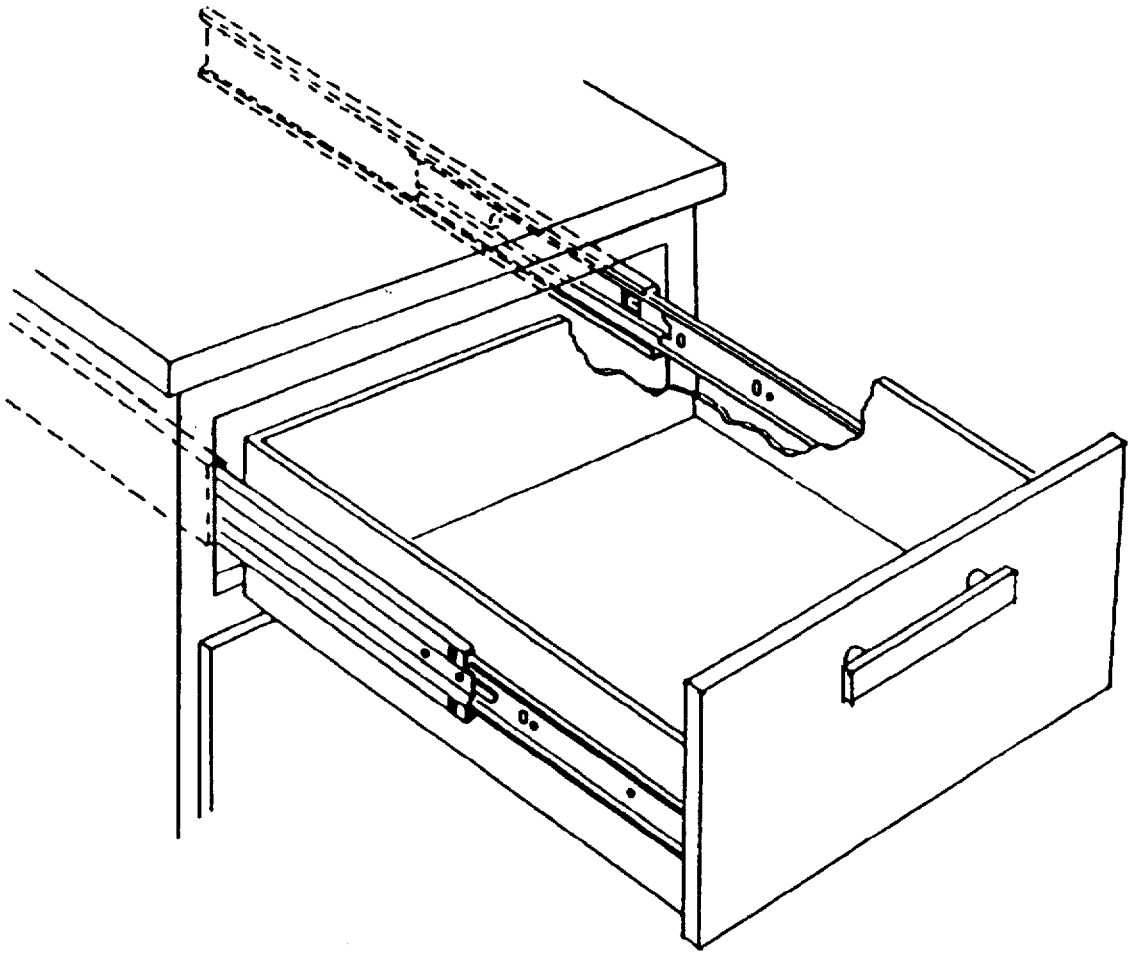
FIG. 7 PRIOR ART
FIG. 7 is a perspective view of a cabinet with a drawer coupled to the cabinet by telescopic slides.

Yet another alternate embodiment of the bearing raceway of the present invention is shown in FIG. 6. As can be seen in the upper U-channel raceway shown in FIG. 6, the horizontal arm 503 has a first segment 511 extending substantially horizontally from the vertical web, a second segment 513 extending vertically outward, from the first segment and a third segment 515 substantially flat extending substantially horizontally from the second segment. The second segment therefore forms a shoulder 501. A lip 19 extends vertically inward from the end of the third segment 515. The third segment in conjunction with the second segment and the lip form a substantially square U-channel bearing raceway. The shoulder 501 performs the same function as the shoulder 401 formed by the indentation 301 as shown in FIG. 5. The shoulder 501 does not provide the bearing retainer clearance provided in the embodiments shown in FIGS. 3–5. The shoulder 501, however, does allow for a predetermined amount of lateral movement of the bearing 23, and may also be desirable to aid in ease of manufacture of the slide member.

Although this invention has been described in certain specific embodiments, many additional modifications and variations will be apparent to those skilled in the art. It is therefore to be understood that this invention may be practiced otherwise than as specifically described. For example, resilient material could be placed in the U-channel to provide a shoulder. Thus, the present embodiments of the invention should be considered in all respects as illustrative and not restrictive, the scope of the invention to be indicated by the appended claims rather than the foregoing description.

What is claimed is:

1. A drawer slide member comprising:

a vertical web;

an arm extending generally horizontally from the vertical web;

a lip extending generally vertically from the arm;

the arm having a generally flat longitudinal bearing raceway receiving bearings therein and a shoulder between the lip and the vertical web, the lip and the shoulder in combination being adapted to partially, but not substantially completely, limit movement of the bearings received by the bearing raceway towards or away from the web, thereby allowing the bearings some lateral movement; and the lip limiting movement of the bearings away from the web.

2. The drawer slide member of claim 1 wherein the lip is adapted to limit movement of the bearings received by the bearing raceway through contact with a retainer holding the bearings received by the bearing raceway.

3. A drawer slide bearing raceway comprising:

a generally flat horizontal longitudinal bearing raceway receiving bearings therein, the bearing raceway having an inner surface and an outer surface, with the bearings received by the inner surface;

a generally vertical lip extending from the bearing raceway adapted for limiting movement of the bearings placed in the raceway in a first lateral direction;

an indentation in the bearing raceway adapted for limiting lateral movement of the bearings placed in the raceway in an opposing lateral direction; and a clearance slot inwardly facing from the inner surface substantially adjacent to the indentation.

4. The drawer slide bearing raceway of claim 3 wherein the vertical lip is adapted for limiting movement of the bearings placed in the raceway by contact with a bearing retainer retaining the bearings placed in the raceway.

5. The drawer slide bearing raceway of claim 4 wherein the indentation is of sufficient dimension to be adapted for limiting movement of the bearings placed in the raceway but is of insufficient dimension to be adapted for contacting the bearing retainer retaining the bearings placed in the raceway.

6. The drawer slide bearing raceway of claim 5 wherein the bearings placed in the raceway are partially restricted from lateral movement.

7. A drawer slide member comprising:

a vertical web;

a generally horizontal lower arm extending from the vertical web with a lower arm upper and lower arm lower surface, the lower arm upper surface having a lower arm first upwardly facing convex surface proximate the vertical web, a second lower arm upwardly facing convex surface distal from the vertical web, and a lower arm upwardly facing concave surface between the lower arm upwardly facing convex surfaces for receiving ball bearings therein; and a generally horizontal upper arm extending from the vertical web with an upper arm upper and upper arm lower surface, the upper arm lower surface having an upper arm first downwardly facing convex surface proximate the vertical web, a second upper arm downwardly facing convex surface distal from the vertical web, and an upper arm downwardly facing concave surface between the upper arm downwardly facing convex surfaces for receiving ball bearings therein.

8. The drawer slide member of claim 7 wherein the horizontal lower arm has a lip extending vertically upward from the end of the arm distal from the vertical web, with the convex and concave surfaces between the lip and the web.

9. The drawer slide member of claim 8 wherein the upper surface of the horizontal lower arm has a sinusoidal shape.

10. The drawer slide of claim 9 wherein the upper surface of the horizontal lower arm has a sinusoidal shape with a non-discontinuous slope.

* * * * *